US007913868B2

(12) United States Patent
Dolan et al.

(10) Patent No.: US 7,913,868 B2
(45) Date of Patent: Mar. 29, 2011

(54) TRIPLE-FLAP CONTAINER CLOSURE

(76) Inventors: Thomas J. Dolan, Flemington, NJ (US); Harold E. Zuber, Wall, NJ (US)

( * ) Notice: Subject to any disclaimer, the term of this patent is extended or adjusted under 35 U.S.C. 154(b) by 895 days.

(21) Appl. No.: 11/811,615

(22) Filed: Jun. 12, 2007

(65) Prior Publication Data

US 2008/0308553 A1 Dec. 18, 2008

(51) Int. Cl.
*B65D 47/08* (2006.01)
*B65D 51/04* (2006.01)
*B65D 51/18* (2006.01)

(52) U.S. Cl. ..... 220/254.2; 220/819; 220/826; 222/556; 222/480

(58) Field of Classification Search ..... 220/254.2, 220/254.3, 254.5, 817, 819; 222/480, 556
See application file for complete search history.

(56) References Cited

U.S. PATENT DOCUMENTS

| | | | | | |
|---|---|---|---|---|---|
| 4,143,695 | A * | 3/1979 | Hoehn | 220/826 |
| 4,412,616 | A * | 11/1983 | Williams | 220/524 |
| 4,414,704 | A * | 11/1983 | Reuter | 16/223 |
| 4,429,800 | A * | 2/1984 | Greenspan | 215/216 |
| 4,723,693 | A * | 2/1988 | DeCoster | 222/483 |
| 4,881,668 | A * | 11/1989 | Kitterman et al. | 222/482 |
| 5,064,088 | A * | 11/1991 | Steffes | 220/837 |
| 5,219,100 | A * | 6/1993 | Beck et al. | 222/480 |
| 6,170,723 | B1 * | 1/2001 | Howell | 224/404 |
| 2004/0089678 | A1 * | 5/2004 | Martin | 222/556 |
| 2007/0068891 | A1 * | 3/2007 | Rathbone et al. | 215/235 |
| 2010/0140304 | A1 * | 6/2010 | Walunis et al. | 222/480 |

* cited by examiner

*Primary Examiner* — Anthony Stashick
*Assistant Examiner* — James N Smalley
(74) *Attorney, Agent, or Firm* — Charles I. Bradsky

(57) ABSTRACT

A flapper cap container closure including a cover-lid having a first flap hinged to the cap and to second and third flaps overlying the apertures of its web, whereby depressing the first flap automatically positions the second and third flaps to depress and seal off the apertures of the closure.

13 Claims, 5 Drawing Sheets

TRIPLE-FLAP CONTAINER CLOSURE

CROSS-REFERENCE TO RELATED APPLICATIONS

NONE.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to dispensing closures for storing and dispensing particulate matter, in general, and, more particularly, to plastic closures having hinged reclosable flaps.

2. Description of the Related Art

Food product container closures having hinged reclosable flaps are known in the art. For example, flapper-cap container closure patents assigned to Gateway Plastics Inc. of Wisconsin include U.S. Pat. Nos. 6,250,517; 6,308,870; 6,460,718; 6,464,113; 6,691,901; D509,426; D513,452; and 7,007,830. Flapper cap patents assigned to Weatherchem Corporation of Ohio include U.S. Pat. Nos. 4,936,494; D340,187; 5,330,082; and RE37,634. Common to their descriptions is the providing of a cover-lid with a first flap overlying a single large dispensing aperture and a second flap overlying a series of smaller dispensing apertures. As will be appreciated, the smaller apertures are utilized as sifters for shaking matter from the container, while (depending on size) the larger aperture allows for spooning matter out of the container, or for using it as a pour spout. Also common to these container configurations are the inclusion of a pair of toggle hinges, to open and then reclose each of the flaps in turn.

Experience with these double-hinge, double-flap constructions, however, has shown that they exhibit several problems. First, the flaps tend not to stay closed, but often pop open so that the particulate matter within is not always sealed. Second, their methods of injection mold manufacture are complicated, and frequently lead to substantial differences in the shrinkages of their respective parts. This causes the closure to go out of round when attempting to screw it onto the container or bottle beneath.

However, and as will be appreciated by those skilled in the art, the container closure of the present invention allows for a simpler molding manufacture, a more effective seal, and a more reliable use of operation. As will be seen, this follows, in part, from the use of a further toggle hinge, resulting in a triple-hinge, triple-flap closure.

SUMMARY OF THE INVENTION

As will be described blow, the triple-hinge, triple-flap closure of the invention allows, as does the prior art, either the smaller sifter apertures or the larger spoon or pour spout aperture to be opened or closed independently. But, the sealing of the container of the invention follows from the closing of the included third flap located between the other two flaps on the cover-lid. The criticality of the prior molding methods in attempting to arrange their individual flap pairs to overlie their respective apertures is thereby eliminated. This follows through the sealing being effected by the third flap of the cover-lid, which automatically brings the two other flaps into position. As will be seen, a third toggle hinge is utilized to effectuate this.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
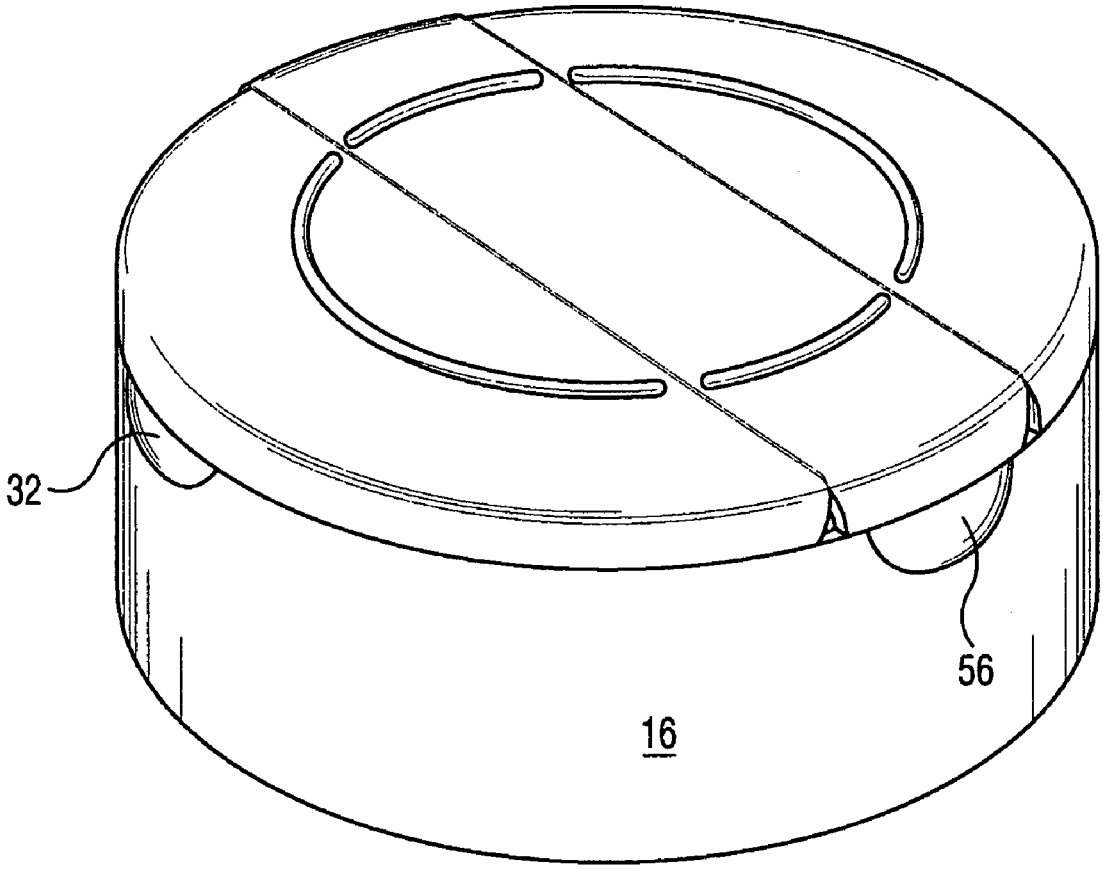
FIG. 1 is a pictorial view of the triple-hinge, triple-flap container closure of the invention with the two prior art flaps in their closed position.
Figure 2:
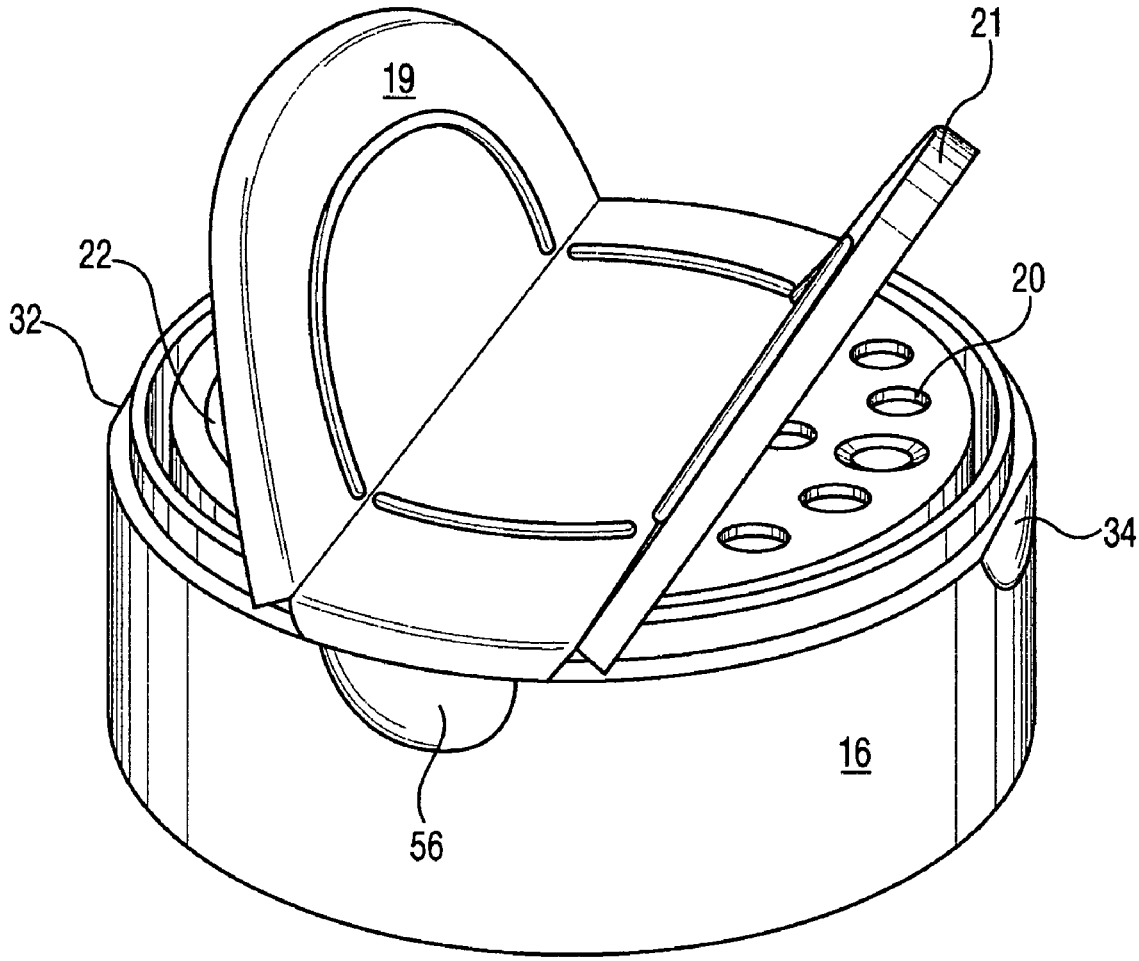
FIG. 2 is a pictorial view of the triple-hinge, triple-flap container with the two prior art flaps in their open position.

In FIGS. 1 through 5, a circular lid or cover for the dispensing closure 10 is shown at 12, joined by a toggle hinge 14 to a cylindrical cap 16. The smaller sifter apertures of a circular web 18 are illustrated at 20, and the larger pour spout aperture is shown at 22. Reference numeral 24 identifies a male snap-lock projection member extending downwardly from the underside of the cover-lid 12 and reference numeral 26 represents a female snap-lock well extending downwardly in the web 18. An orifice 28 is provided in the snap-lock well 26 to prevent any particulate product from collecting there, falling instead into the cylindrical container or bottle beneath (not shown).

As the drawings illustrate, the male snap-lock projection member 24 is configured to fit within the female snap-lock well 26, and a locking ring 30 within the well 26 retains the male member 24 in place. The product passage orifice 28 within the female locking well 26 allows passage of the particulate product back into the dispensing container should there be a tendency of particulate to build up within the well. Reference numeral 32 identifies a finger detent for opening a first flap 19 which overlies the pour spout aperture 22. Reference numeral 34 identifies a finger detent for opening a second flap 21 which overlies the sifter apertures 20. Both detents open by an upward pushing movement. Reference numeral 36 identifies an injection mold gate for forming the dispensing closure of plastic.

Figure 3:
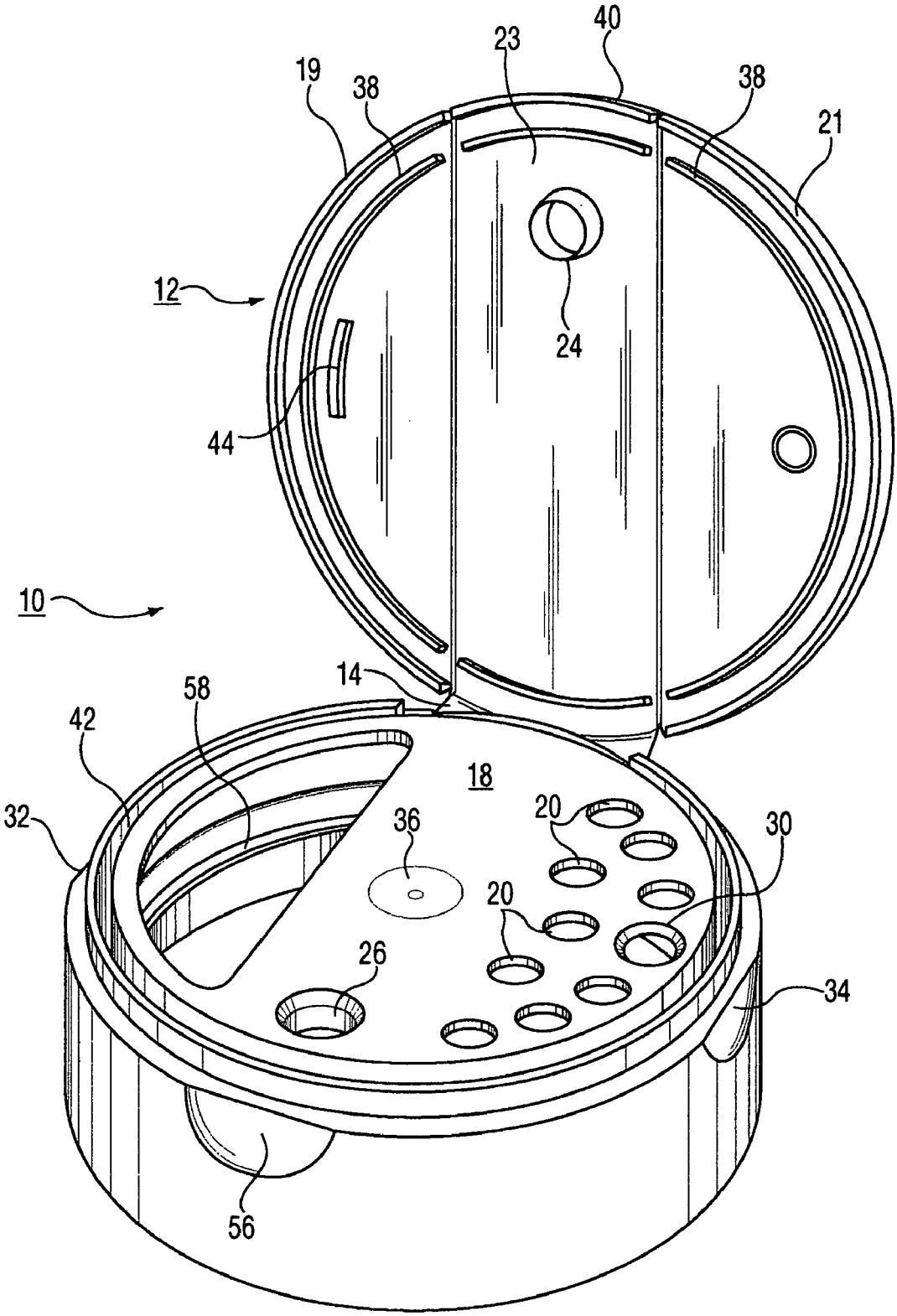
FIG. 3 is a pictorial view of the triple-hinge, triple-flap container with the third flap open, as well as the prior art pair.
Figure 4:
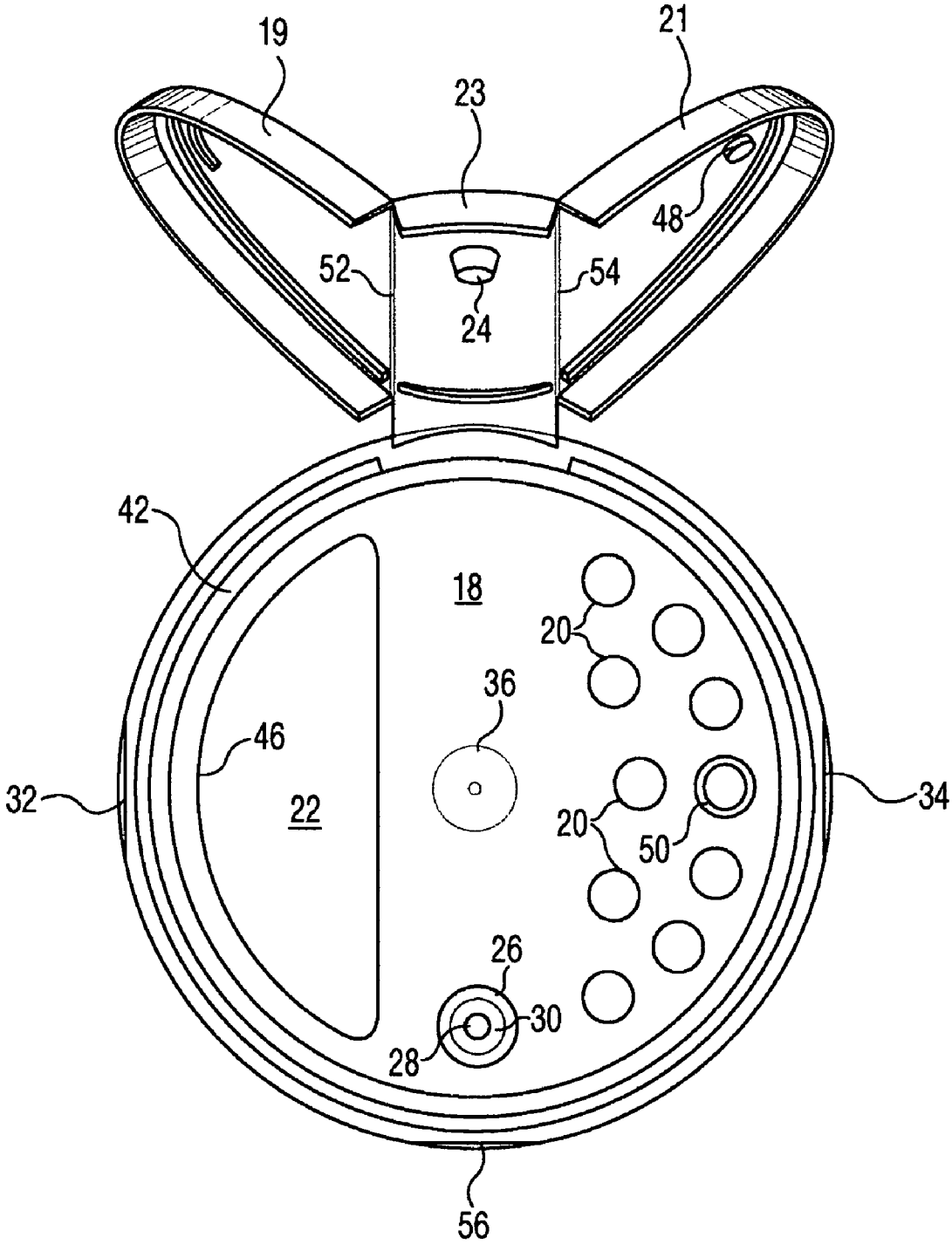
FIGS. 4 and 5 are helpful in an understanding of the deployment and operation of the added third flap of the container closure.
Figure 5:
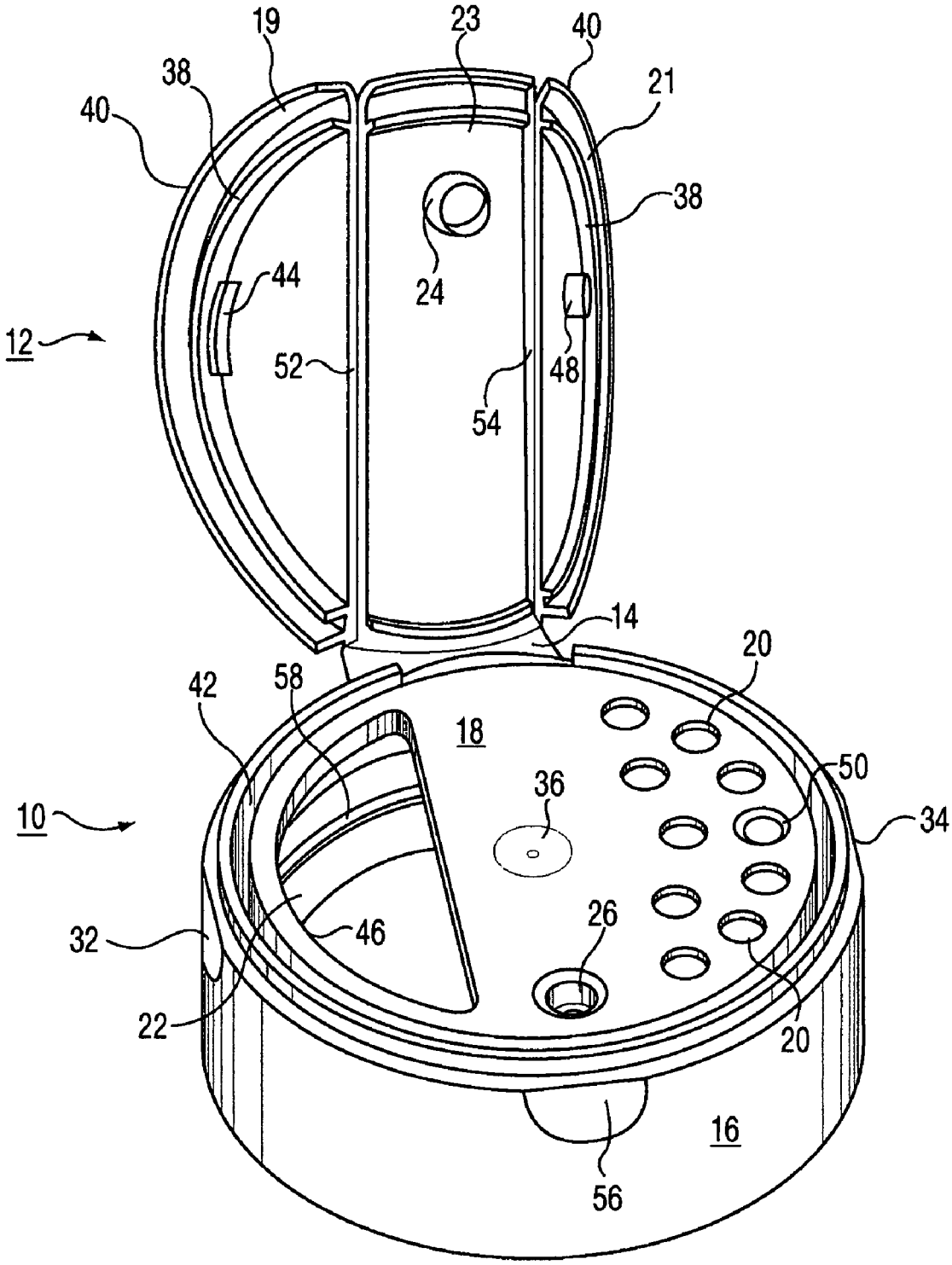

As FIGS. 3-5 illustrate, a male valve seal ring 38 extends downwardly from the underside of the cover-lid 12 near its extreme circumference 40. The ring 38 is configured to fit within a female valve seat 42 encircling the web 18, to which it is joined by the hinge 14 constructed in three dimensions to give it a toggle action as the cover-lid 12 opens and closes. Inwardly of the male valve seal ring 38 on the underside of the cover-lid 12 is a downwardly extending projection 44 configured to bear against an edge 46 of the pour spout aperture 22 in fixing the flap 19 closed when it is pressed downwardly. A male snap-lock projection 48 similarly extends downwardly from the underside of the cover-lid 12 inwardly of its circumference 40, configured to fit within a female snap-lock well 50 amongst the smaller sifter apertures 20 to likewise close the flap 21 when it is pressed downwardly.

As is more clearly shown in FIGS. 4 and 5, the flaps 19 and 21 rotate about hinges 52, 54 on opposite sides of a third flap 23, according to the invention. A third finger detent 56 is provided for opening the flap 23 (and thereby the cover-lid 12) by an upward pushing movement. As will be seen, it is on the underside of this third flap 23 that the snap lock projection member 24 is positioned.

In operation, the cover-lid 12 is first closed by the lowering of the flap 23 such that the male snap-lock projection member 24 fits within the female snap-lock well 26. The flaps 19 and 21 are then lowered to close the male valve seal ring 38 within the female valve seat 42 encircling the web 18. The projections 44 and 48 thus close to seal the pour spout aperture 22 and the smaller sifter apertures 20 in like manner to effectuate the container closure.

A continuous thread 58 is in the nature of a screw thread for attaching the dispensing closure to the container or bottle—and the circumferential valve seal formed between the underside of the cover-lid 12 and the web 18 prevents any component of the lid and the web contacting one another to affect the efficacy and positive nature of the seal.

With the triple-hinge, triple flap container closure of the invention, its construction allows the closure to be molded on the flat as a single piece, followed by a sonic sealing to melt the plastic in adhering the cover-lid 12 to the cap. The resulting hinges last longer in this manner, and the individual flaps 19 and 21 remain closed. Increased positive sealing results, with a longer lasting life for the closure.

While there has been described what is considered to be a preferred embodiment of the present invention, it will be readily appreciated by those skilled in the art that modifications can be made without departing from the scope of the teachings herein. For at least such reason, therefore, resort should be had to the claims appended hereto for a true understanding of the scope of the invention.

We claim:

1. A dispensing closure for a cylindrical container comprising:

a cylindrical cap attached to said container;

a circular lid hinged to said cap for opening and closing said cap;

a circular web having a plurality of apertures upwardly facing from said cap toward said lid;

a two-component seal, one component being a male member ring extending downwardly from an underside of said lid inwardly of its outer circumstance, and one component being a female member seat encircling said web;

whereby depressing said lid encloses said male member ring onto said female member seat; and whereby said circular lid consists of an integral, single piece construction including first and second flaps hinged to opposing sides of an included third flap operative to hinge said circular lid to said cap in opening and closing said cap and with said first and second flaps being individually and independently operable and closable with respect to said third flap.

2. The dispensing closure of claim 1, also including a pair of finger detents on said cylindrical cap to respectively open each of said first and second flaps by an upwards pushing movement.

3. The dispensing closure of claim 2, additionally including a third finger detent on said cylindrical cap to open said third flap by an upwards pushing movement.

4. The dispensing closure of claim 2 wherein said web includes a first aperture overlain by one of said first and second flaps when closed, and a plurality of smaller apertures overlain by said other of said first and second flaps when closed.

5. The dispensing closure of claim 4, also including a two-component lock, one component being a male member projection downwardly extending from an underside of said third flap of said lid and one component being a female member well within said web oriented to receive said male member projection, whereby depressing said third flap positions said male member projection within said female member well.

6. The dispensing closure of claim 5, also including a locking ring within said female member well to envelop said male member projection securing it into position.

7. The dispensing closure of claim 5 wherein said cylindrical cap is detachably attached to said container.

8. The dispensing closure of claim 5, also including a second two-component lock, one component being a second male member projection downwardly extending from an underside of said second flap and one component being a second female member well within said plurality of smaller apertures, whereby depressing said second flap positions said second male member projection within said second female member well.

9. The dispensing closure of claim 8, additionally including a third two-component lock, one component being a third male member projection downwardly extending from an underside of said first flap and one component being an edge surface of said first aperture, whereby depressing said first flap positions said third male member projection against said edge surface of said first aperture.

10. The dispensing closure of claim 8, additionally including a third finger detent on said cylindrical cap to open said third flap by an upwards pushing movement.

11. The dispensing closure of claim 9, also including a locking ring within said first female member well to envelop said first male member projection securing it into position.

12. A dispensing closure for a cylindrical container comprising:

a cylindrical cap attached to said container;

a circular lid hinged to said cap;

a circular web having a plurality of apertures upwardly facing from said cap toward said lid;

a two-component seal, one component being a male member ring extending downwardly from an underside of said lid inwardly of its outer circumstance, and one component being a female member seat encircling said web;

whereby depressing said lid encloses said male member ring onto said female member seat; and whereby said circular lid includes first and second flaps hinged to opposing sides of an included, third flap and openable and closable with respect thereto;

also including a pair of finger detents on said cylindrical cap to respectively open each of said first and second flaps by an upwards pushing movement;

wherein said web includes a first aperture overlain by one of said first and second flaps when closed, and a plurality of smaller apertures overlain by said other of said first and second flaps when closed;

also including a two-component lock, one component being a male member projection downwardly extending from an underside of said third flap of, said lid and one component being a female member well within said web oriented to receive said male member projection, whereby depressing said third flap positions said male member projection within said female member well;

also including a locking ring within said female member well to envelop said male member projection securing it into position.

13. A dispensing closure for a cylindrical container comprising:

a cylindrical cap attached to said container;

a circular lid hinged to said cap;

a circular web having a plurality of apertures upwardly facing from said cap toward said lid;

a two-component seal, one component being a male member ring extending downwardly from an underside of said lid inwardly of its outer circumstance, and one component being a female member seat encircling said web;

whereby depressing said lid encloses said male member ring onto said female member seat; and whereby said circular lid includes first and second flaps hinged to opposing sides of an included third flap and openable and closable with respect thereto;

also including a pair of finger detents on said cylindrical cap to respectively open each of said first and second flaps by an upwards pushing movement;

wherein said web includes a first aperture overlain by one of said first and second flaps when closed, and a plurality of smaller apertures overlain by said other of said first and second flaps when closed;

also including a two-component lock, one component being a male member projection downwardly extending from an underside of said third flap of said lid and one component being a female member well within said web oriented to receive said male member projection, whereby, depressing said third flap positions said male member projection within said female member well;

also including a second two-component lock, one component being a second male member projection downwardly extending from an underside of said second flap and one component being a second female member well within said plurality of smaller apertures, whereby depressing said second flap positions said second male member projection within said second female member well;

additionally including a third two-component lock, one component being a third male member projection downwardly extending from an underside of said first flap and one component being an edge surface of said first aperture, whereby depressing said first flap positions said third male member projection against said edge surface of said first aperture;

also including a locking ring within said first female member well to envelop said first male member projection securing it into position.

* * * * *